United States Patent [19]

Kucera et al.

[11] Patent Number: 4,727,616

[45] Date of Patent: Mar. 1, 1988

[54] PICK UP ROLLER

[76] Inventors: Ronald Kucera, 1641 Kenneth Rd., Glendale, Calif. 91201; John Sartuche, 10508-3 Sunland Blvd., Sun Valley, Calif. 91040

[21] Appl. No.: 907,317

[22] Filed: Sep. 15, 1986

[51] Int. Cl.[4] ..... A47L 25/00

[52] U.S. Cl. ..... 15/104 A; 15/145; 15/230.11

[58] Field of Search ..... 15/104 A, 143 B, 145, 15/230.11

[56] References Cited

U.S. PATENT DOCUMENTS

| | | | |
|---|---|---|---|
| 3,343,194 | 9/1967 | Ramelson | 15/104 A |
| 3,417,418 | 12/1968 | Riboud | 15/104 A |
| 3,742,547 | 7/1973 | Sohmer | 15/104 A |

*Primary Examiner*—Chris K. Moore

*Attorney, Agent, or Firm*—James E. Brunton

[57] ABSTRACT

A lint removal apparatus having a length of adhesive coated tape wound upon a cylindrical core which is rotatably carried by a two-piece handle assembly. Each successive layer, or winding, of adhesive tape is provided with a diagonally extending cut which extends partially, but not completely, across the width of the winding. With this construction, an uncut band of material is formed proximate one edge of the core. As each successive winding is stripped from the core as the winding becomes contaminated, the uncut band of the winding will tear automatically causing a tab of the underlying winding to be upraised. In this way, a tab of the winding of adhesive tape will always be upraised after the removal of the contaminated layer of tape to facilitate removal of the next winding as it becomes contaminated.

8 Claims, 6 Drawing Figures

PICK UP ROLLER

BACKGROUND OF THE INVENTION

1. Field of the Invention

The present invention relates generally to cleaning apparatus. More particularly the invention concerns a lint removing device of the character having a plurality of layers of adhesive-coated tape wound upon a cylindrical core. The layers of tape are partially cut along a diagonally extending line so as to form a plurality of sheets or windings which can be sequentially removed as the apparatus is used.

2. Discussion of the Prior Art

Various types of lint pick-up devices have been suggested in the past. Typically these devices comprise a length of pressure sensitive masking tape wound upon a core which is rotatably carried by a support or handle. Generally, the pressure sensitive masking tape is scored along its center width so as to define a plurality of individual windings which may be sequentially removed from the core after they have become contaminated. Exemplary of such prior art devices are those described in U.S. Pat. No. 3,342,325 issued to Dreher and U.S. Pat. No. 3,417,418 issued to Ribound, et al. This latter patent describes a lint pick-up or cleaning roller comprising a support, a cylinder rotatably mounted on the support and a plurality of adhesive-coated sheets spirally wound in layers on the cylinder so that the dge of the sheets are spaced apart.

In using the lint pick-up devices of the prior art, the adhesive material is placed against the article to be cleaned, such as wearing apparel, and is rolled relative to the article so that as the cleaning roller rotates about its longitudinal axis the adhesive layer lightly engages the material to be cleaned. When the outer layer of the adhesive material becomes saturated with lint or other foreign material, lifted from the article the saturated sheet is stripped away from the core exposing a fresh, uncomtaminated layer.

The basic problem inherent in the prior art lint pickup devices known to the present inventor resides the difficulty of stripping away each successive layer of the adhesive material from the core as it becomes contaminated. In the first place, it is usually very difficult visually to locate an edge or corner that can be raised to permit the contaminated winding to be gripped and peeled from the next succeeding winding on the core. Secondly, when a corner or edge is located, it must in some way be raised sufficiently so that it can be gripped with enough force to remove the saturated winding from the core. Because of the fragile nature of the adhesive material, this step of locating and then raising a corner or edge of the winding is often frustrating and time consuming. Frequently even after the corner is raised with a fingernail or sharp object it will tear causing the winding to peel unevenly or not to peel at all.

Several approaches have been suggested in the past to solve these highly annoying problems. For example, in the previously identified Ribound patent, the problem was sought to be solved by leaving a gap between the turn of the spirals of each layer or winding of the material and further by coloring one edge of each layer differently from the remainder thereof. While this construction makes it easier to visually locate the edge of the spiral layer to be removed, it does not effectively solve the problem of raising a corner or edge which can be gripped with sufficient force to peel the contaminated layer from the core.

The present invention is directed specifically to the solution of the problems discussed in the preceding paragraphs. As will be more fully appreciated from the discussion which follows, the present inventor has solved these difficult and annoying problems in a unique way by partially, but not completely, cutting each successive layer or winding of the adhesive tape along a generally diagonally extending line. With this construction, each successive layer of material includes an uncut, circumferentially extending band of material. Accordingly, as each successive winding is stripped from the core, when the uncut band of the winding is reached, the band will tear in a manner to cause a ragged tab of the next adjacent underlying winding to be upraised. In this way, one corner of the winding of adhesive tape will always be positively upraised after the removal of each successive layer of the contaminated tape. It is then a simple matter to locate and lap over a portion of the upraised corner before using the apparatus for the next successive cleaning operation. After the cleaning step, which causes the winding to become contaminated, the folded over corner portion remains easily locatable and easily grasped so as to enable the quick and expeditious removal of the next contaminated layer or winding.

To further facilitate the removal of each successive contaminated winding of the tape, the narrow circumferentially extending uncut band of tape is brightly colored with an ink or similar coloring medium. The ink or other coloring medium accomplishes two beneficial results. First, by selecting an ink of a bright color, such as red, blue or green, the torn, up-lifted tab on each successive winding or layer is easily visible. Second, the ink functions to cover or mask the adhesive facing on the tape uncut band of tape enabling it to be readily separable from the next adjacent layer of the uncut band. This masking of the adhesive material on the uncut band facilitates the upraising of the tab on the next succeeding winding as the band is torn during the stripping away of the contaminated layer from the core.

SUMMARY OF THE INVENTION

It is an object of the invention to provide a lint pickup apparatus of the character having a plurality of adhesive windings on a rotatable core. Each successive winding of adhesive material can be quickly and easily removed without having to search for a free corner or edge and without having to painstakingly upraise the corner or edge so that the adhesive layer can be stripped away.

Another object of the invention is to provide an apparatus of the aforementioned character in which, as each successive layer of adhesive material is stripped from the rotatable core, an upraised gripping tab is automatically formed.

A further object of the invention is to provide an apparatus as described in the previous paragraphs in which the upraised tab is of a different color than the rest of the adhesive winding so that it can easily be seen.

Still another object of the invention is to provide an apparatus of the character described which is simple to manufacture and can be inexpensively produced

BRIEF DESCRIPTION OF THE INVENTION

Figure 1:
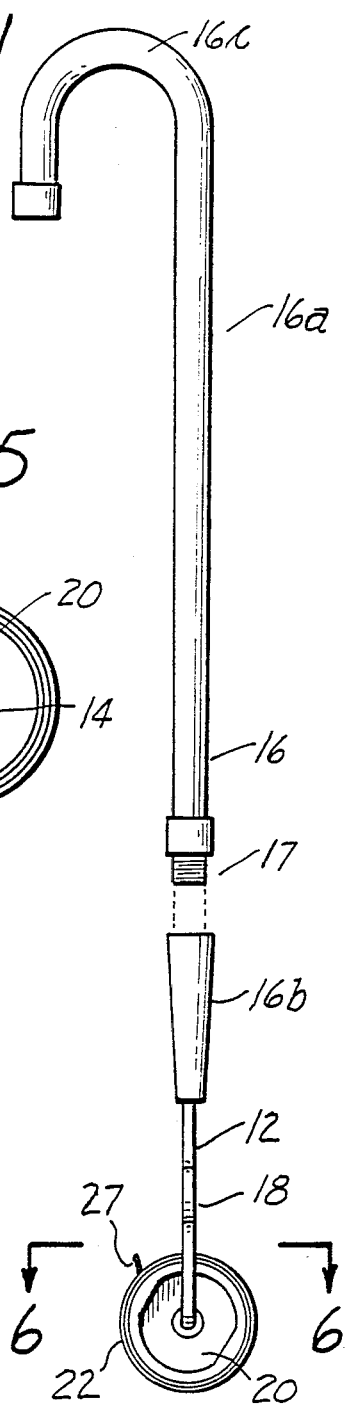
FIG. 1 is a side elevational, exploded view of the pickup roller of the present invention.
Figure 2:
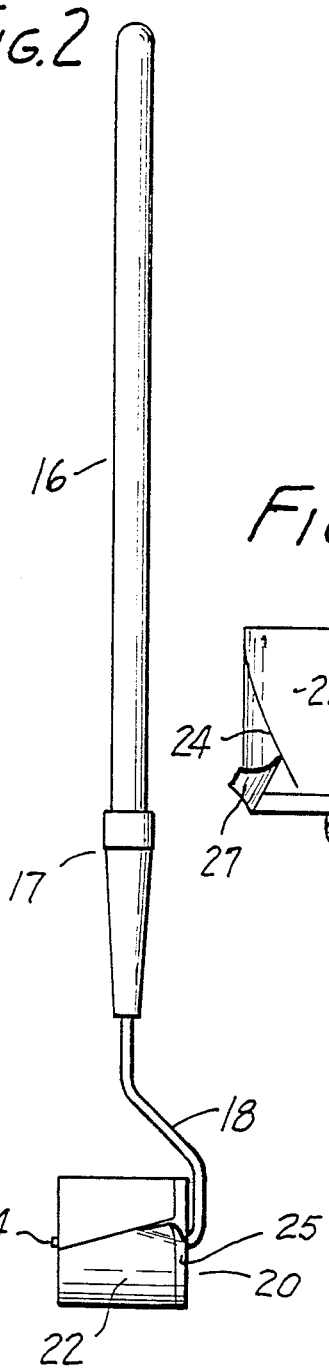
FIG. 2 is a front view of the pick-up roller showing the first and second handle portions threadably interconnected.

Referring to the drawing and particularly to FIGS. 1 and 2, the lint pick-up roller of the present invention comprises a support 12 including an axle member 14, a handle member 16 extending generally perpendicularly to the longitudinal axis of the axis 14 and an interconnecting, bent rod 18 which interconnects handle 16 with axle 14. A cylinder 20 is carried by axle member 14 for rotation about the longitudinal axis of the axle 14. A plurality of windings of a generally planar tape-like material is wound about cylinder 20. Each of the windings is of a width substantially co-extensive with the width of the cylinder (FIG. 4) and each winding has an outwardly facing adhesive surface 22.

Figure 4:
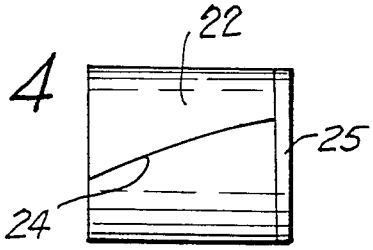
FIG. 4 is a front view of the roller of the apparatus showing the arrangement of the diagonally extending cut which extends partially of the width of each of the adhesive windings.

As best seen by referring to FIG. 4, an extremely important feature of the present invention is the fact that each layer or winding of the adhesive material is cut along a substantial portion of a line 24 which extends diagonally across each winding at an acute angle with respect to the longitudinal axis of the cylinder and the longitudinal axis of axle 14. It is important to note that these cuts in each of the successive windings extends partially, but not entirely across the winding. With this construction, a narrow circumferentially extending band 25 is defined at the edge of each successive winding of the adhesive material. As will be discussed in greater detail in the paragraphs which follow, this uncut, circumferentially extending band serves the highly important function of providing a tearing action which forms an upraised gripping tab upon the stripping of each successive winding of adhesive material from the roller.

In the preferred form of the invention, the circumferentially extending band 25 is colored or stained with an ink or other suitable material. This coloring provides a sharp visual distinction between the band 25 and remaining uncolored the main body of the adhesive material winding.

In addition to providing a color distinction so that the upraised tab 27 (FIGS. 5 and 6) can easily be seen, the ink or stain also masks the adhesive material so that each succeeding layer of material wound about the core will not be adhesively joined to the next succeeding layer in the area of the band 25. This masking of the adhesive results in a superior tearing action of the material in the area of the band so as to cause a formation of a markedly upraised tab position 27 of the character shown in FIGS. 5 and 6.

While various materials may be used as the coloring agent to color the band area 25, such as ink or other dyes, common printers' ink, preferably in colors of red, green, or blue has proven satisfactory for coloring the band 25 and for masking the adhesive material on each successive winding to facilitate the upraising of the tab as the windings are stripped from the roller.

Another important feature of the present invention resides in the construction of the handle. As best seen in FIG. 1, the handle 16 comprises a first upper portion 16*a* and a second lower portion 16*b*. Portions 16*a* and 16*b* are threadably interconnected at 17 so that handle portion 16*a* can readily be disconnected from handle portion 16*b*. When so disconnected, the apparatus can be used for cleaning clothing and like articles with the user gripping the hand grip portion defined by the portion 16*b* of the handle. When it is desired to clean carpets or like objects, portion 16*a* of the handle can be threadably interconnected with portion 16*b* and the device can be rolled along the carpet while the user remains in a standing position. To facilitate use of the device in this manner, the upper most extremity of handle portion 16*a* is curved to form a cane-like handle portion 16*c*.

Figure 5:
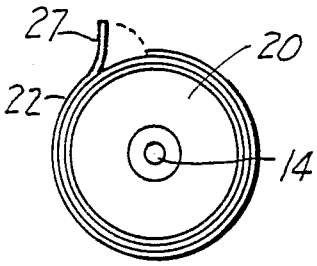
FIG. 5 is an enlarged diagramatic end view of the roller showing the manner in which a tab portion of each successive layer of adhesive winding is raised as each contaminated winding is stripped from the roller.
Figure 6:
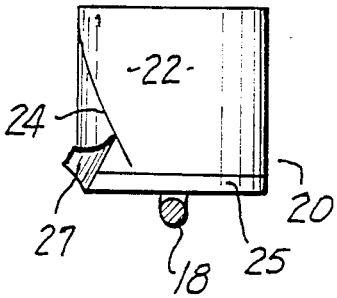
FIG. 6 is a view taken along line 66 of FIG. 1 further illustrating the configuration of the upraised tab which results from the stripping of the contaminated layer of material from the roller and the tearing of the uncut margin of the winding to automatically provide the upraised gripping tab.
Figure 3:
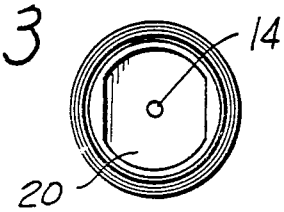
FIG. 3 is an end view of the roller portion of the apparatus which carries a plurality of windings of an adhesive material.

When the apparatus is sold to the user, the roll is provided with a tab 27 in an upstanding configuration illustrated in FIG. 6. When the roller is rolled over an object to remove lint, this tab portion will remain clearly visible and will not firmly adhere to the next adjacent layer or winding of adhesive material. When the outer winding of material becomes contaminated with lint, hair and other foreign objects removed from the carpet or from clothing, the user grasps tab 27 and pulls the entire outer winding away from the roller so as to expose a fresh, uncontaminated layer or winding of adhesive material. As this contaminated layer is stripped from the roller, the final stripping action will result in a tearing of the marginal portion 25 of the material which portion remains uncut along line 24. Stated another way, because the adhesive layer is not completely cut along the width of the band 25, as a contaminated layer of the material is stripped from the roller, a new upstanding tab portion 27 will be formed due to the tearing action of the material in the area of the band 25. This tab 27 will assume an upstanding configuration as indicated in FIG. 5. Because the band 25 is of a different color, the tab is easily seen and can be folded under if desired so as to provide an easy gripping extremity when it is desired to once again strip the contaminated winding from the roller. It is to be appreciated that as each winding becomes successively contaminated and is stripped from the roller, a new tab 27 will be formed as a result of the tearing action of the uncut portion of the material in the area of the band 25. This highly unique feature of the invention permits each successive winding of adhesive material to be easily removed without the difficulty of finding and peeling loose a corner which can be gripped by the user to enable the stripping of the outer windings from the roller.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A pick-up roller comprising:
(a) A support;
(b) A cylinder carried by said support for rotation about its longitudinal axis; and
(c) plurality of windings of material wound about said cylinder, each of said windings having an outwardly facing adhesive surface and having a continuous cut along a substantial portion of a line extending across each said winding to define a circumferentially extending narrow band of uncut windings disposed proximate one edge of said cylinder.

2. A pick-up roller as defined in claim 1 in which said support comprises an axle member receivable axially of said cylinder and an elongated handle connected to said axle and extending substantially perpendicular to the longitudinal axis of said cylinder.

3. A pick-up roller as defined in claim 2 in which said handle comprises a first portion having a first hand grip and a second portion having a second hand grip. Said second portion being threadably connected to said first portion.

4. A lint pick-up roller apparatus comprising:
(a) A support including an axle member and a perpendicularly extending handle member;
(b) A cylinder carried by said axle member of said support for rotation about the longitudinal axis of said axle; and
(c) A plurality of windings of tape wound about said cylinder, each of said windings being of a width substantially co-extensive with the width of said cylinder and having an outwardly facing adhesive surface, each of said windings being cut along a substantial portion of a line extending across each said winding at an acute angle with respect to the longitudinal axis of said cylinder and each of said windings being provided with a circumferentially extending narrow band of a different color, one edge of said band being co-extensive with the edge of said winding and the other edge thereof being aligned with the inner extremity of the cut extending partially across each said winding.

5. A pick-up roller as defined in claim 4 in which said handle member comprises a first portion having a first hand grip and second portion having a second hand grip. Said second portion being connected to said first portion.

6. A pick-up roller as defined in claim 1 in which said cut extending across each said winding extends diagonally at an acute angle with respect to the longitudinal axis of said cylinder.

7. A pick-up roller comprising:
(a) A support;
(b) A cylinder carried by said support for rotation about its longitudinal axis; and
(c) plurality of windings of material wound about said cylinder, each of said windings having an outwardly facing adhesive surface and being cut along a substantial portion of a line extending across each said winding, each of said windings being further provided with a circumferentially extending narrow band of a different color, one edge of said band being co-extensive with the edge of said winding and the other edge thereof being aligned with the inner extremity of the cut extending partially across each said winding.

8. A pick-up roller as defined in claim 8 in which said cut extending across each said winding extends diagonally at an acute angle with respect to the longitudinal axis of said cylinder.

* * * * *